US007255783B2

(12) United States Patent
Bruggeman et al.

(10) Patent No.: US 7,255,783 B2
(45) Date of Patent: Aug. 14, 2007

(54) USE OF INFRARED IMAGING TO REDUCE ENERGY CONSUMPTION AND FLUORIDE CONSUMPTION

(75) Inventors: Jay N. Bruggeman, Harrison City, PA (US); Michael L. Slaugenhaupt, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 501 days.

(21) Appl. No.: 10/645,069

(22) Filed: Aug. 21, 2003

(65) Prior Publication Data

US 2005/0040047 A1 Feb. 24, 2005

(51) Int. Cl.
*C25C 3/22* (2006.01)

(52) U.S. Cl. ..... 205/391; 205/396; 205/392; 205/393; 205/394; 204/243.1; 204/247; 204/247.5

(58) Field of Classification Search ..... 205/392, 205/393, 394, 396, 372, 391; 204/243.1, 204/247, 247.5

See application file for complete search history.

(56) References Cited

U.S. PATENT DOCUMENTS

| | | | | |
|---|---|---|---|---|
| 4,448,661 | A | 5/1984 | Roggen | 204/243 R |
| 4,668,350 | A * | 5/1987 | Desclaux et al. | 205/336 |
| 4,764,257 | A | 8/1988 | Sadoway | 204/1 T |
| 4,770,752 | A * | 9/1988 | Gianfranco | 205/391 |
| 4,867,851 | A | 9/1989 | Basquin et al. | 204/67 |
| 5,439,563 | A | 8/1995 | Sivilotte | 204/70 |
| 6,183,620 | B1 | 2/2001 | Verstreken | 205/336 |
| 6,440,294 | B1 * | 8/2002 | Cotten | 205/367 |
| 7,001,497 | B2 * | 2/2006 | Gagne et al. | 205/81 |
| 7,112,269 | B2 * | 9/2006 | Slaugenhaupt et al. | 205/336 |
| 2002/0146057 | A1 * | 10/2002 | Barron et al. | 374/130 |
| 2004/0211663 | A1 * | 10/2004 | Gagne et al. | 204/280 |
| 2006/0037863 | A1 * | 2/2006 | Slaugenhaupt et al. | 205/82 |

FOREIGN PATENT DOCUMENTS

EP 1 344 847 A1 9/2003

OTHER PUBLICATIONS

"Practical Considerations Used in the Development of a Method for Calculating Aluminum Fluoride Additions Based on Cell Temperatures"; Michael J. Wilson; Light Metals 1992, pp. 375-378, XP002183962.

U.S. EPA Office "Primary Aluminum Indusrty: Technical Support Document for Proposed MACT Standards" 1996.

* cited by examiner

*Primary Examiner*—Bruce F. Bell
(74) *Attorney, Agent, or Firm*—Greenberg Traurig, LLP

(57) ABSTRACT

Operations in an electrolytic cell for producing aluminum are controlled by sensing infrared radiation on an outer surface of a cell chamber to determine an actual temperature. When the actual temperature is greater than a target temperature, a crust hole is repaired or the actual rate of addition of aluminum fluoride to the cell is increased. When the actual temperature is less than a target temperature, the actual rate of addition of aluminum fluoride to the cell is reduced.

10 Claims, 2 Drawing Sheets

USE OF INFRARED IMAGING TO REDUCE ENERGY CONSUMPTION AND FLUORIDE CONSUMPTION

FIELD OF THE INVENTION

The present invention relates to controlling operations of aluminum production cells in order to improve energy efficiency and to reduce fluoride emissions.

BACKGROUND OF THE INVENTION

Production of aluminum by the Hall-Heroult process makes use of a cell having a chamber containing alumina dissolved in a molten cryolite electrolyte bath. It is standard practice to add aluminum fluoride regularly to the cryolite so that the $NaF/AlF_3$ mass ratio is maintained at about 0.80-1.20.

The cryolite bath is covered by a solid crust that is punctured regularly when molten aluminum is tapped from the cell. Increasing the area of the open crust holes results in more fluoride evolution from the smelting pot, thereby increasing load on the pot scrubber and the resulting smelter fluoride emission level.

Increasing the average area of open crust holes in a pot line also increases variations in the bath ratio, resulting in poorer cell performance. This occurs because the amount of fluoride evolved from individual pots fluctuates while each pot continues to receive a relatively constant supply of fluoride in reacted ore from the dry scrubber line, plus the same daily maintenance supply of aluminum fluoride. These factors make it desirable to quantify the effects of pot operating practices on fluoride evolution in order to prioritize various efforts to minimize fluoride evolution.

In the prior art, some attempts have been made to control aluminum fluoride additions to smelting cells. Such attempts, however, suffer from one or more serious disadvantages making them less than entirely suitable for their intended purpose.

Desclaux et al. U.S. Pat. No. 4,668,350 issued May 26, 1987 represents an effort in the prior art to control the rate of addition of aluminum fluoride to a cryolite-based electrolyte in an aluminum production cell. The claimed method requires regular measurements of cell temperature, either directly or by means such as a thermocouple inserted in the side wall or in the floor, or in a cathode current collector in the cell floor.

A principal objective of the present invention is to provide a process for controlling additions of aluminum fluoride to individual aluminum electrolysis cells.

A related objective of the invention is to provide a process for controlling inspections and repairs for crust holes in aluminum production cells so that such inspections and repairs are performed where and as needed.

Another important objective of the invention is to reduce energy requirements for operating aluminum electrolysis cells.

Additional objectives and advantages of our invention will become apparent to persons skilled in the art from the following detailed description of some particularly preferred embodiments.

SUMMARY OF THE INVENTION

In accordance with the present invention there is provided an electrolytic cell wherein aluminum is produced by electrolysis of alumina dissolved in a molten salt bath. A preferred cell comprises a pot defining a chamber containing the molten electrolyte, a cathode, at least one anode contacting the electrolyte, and a solid crust above the electrolyte. The crust comprises solidified electrolyte and alumina, and may build up to a thickness of several inches.

The molten electrolyte comprises sodium fluoride and aluminum fluoride in a weight ratio of about 0.7-1.2, together with lesser amounts of magnesium fluoride and calcium fluoride. The molten electrolyte has a temperature of at least about 900° C., more preferably about 900-1050° C. The electrolyte is preferably maintained at a temperature of about 960-980° C. As reduction proceeds, a pad of molten aluminum settles on the cell bottom above the cathode.

In order to tap molten aluminum from the cell the crust is broken periodically, leaving a hole through which heat is lost from the electrolyte and fluorides are evolved into the chamber. Cell voltage is increased to compensate for the lost heat, thereby increasing power consumption. The solid crust must also be broken away to replace spent anodes.

Heat loss from the cell is reduced by repairing the crust holes. Crust hole repair may be effected by covering the holes with a loose mass of solid particles or by covering the holes with solid particles contained in a receptacle as described in Cotten U.S. Pat. No. 6,400,294, the disclosure of which is incorporated by reference. Solid particles suitable for crust repair include alumina, aluminum fluoride, cryolite, and mixtures thereof in varying proportions.

Pot lines of electrolytic cells for aluminum production are also provided with ducts for carrying away fumes evolved by the cells. The evolved fumes contain aluminum fluoride, hydrogen fluoride, alumina, water, and dust. In order to reduce fluoride emissions, the fumes are scrubbed in solid vessels containing smelting grade alumina that is later fed to the cells.

In accordance with our invention we determine a standard rate of addition of aluminum fluoride to each cell in a pot line, by measuring approximately the average aluminum fluoride requirement over a period of time. The standard rate of addition of aluminum fluoride may vary from time to time.

A target temperature is established for the pot's hood (i.e. outer surface of the chamber). The target temperature is preferably an ideal temperature as measured by means of an infrared sensor which may be mounted on an overhead crane.

The infrared sensor scans the thermal image of the pot's hooding multiple times during its travel adjacent the potline. A processor or thermal imaging analysis software is then used to extrapolate the temperature of the outer surface of the hood. From this temperature we can estimate the open area in the anode covering crust and predict the daily $AlF_3$ addition for each individual pot.

When the actual temperature of the pot's hood is greater than the target temperature, we inspect the crust for crust holes and when a crust hole is observed, it is repaired. If after the repair it is determined that the level of $AlF_3$ is still too low, then the actual rate of addition of aluminum fluoride is increased above the standard rate. When the actual temperature of the pot's hood is less than the target temperature, the actual rate of aluminum fluoride addition to the cell is reduced below the standard rate.

Alternatively, if the actual temperature of the pot's hood is greater than the target temperature, the actual rate of addition of aluminum fluoride may be increased above the standard rate without inspecting the crust for crust holes. When the actual temperature of the pot's hood is less than the target temperature, the actual rate of aluminum fluoride addition to the cell is reduced below the standard rate.

The steps of measuring the pot's actual hood temperature by thermal imaging, inspecting and repairing the crust, and varying the actual rate of aluminum fluoride addition either above or below the standard rate, are repeated as often as necessary. When the measured temperature of the pot's hood is about equal to the target temperature, the rate of aluminum fluoride addition is unchanged. We have discovered that maintaining pot heat balance in accordance with the invention minimizes energy requirements for operating an aluminum electrolysis cell.

DETAILED DESCRIPTION OF PREFERRED EMBODIMENTS

Figure 1:
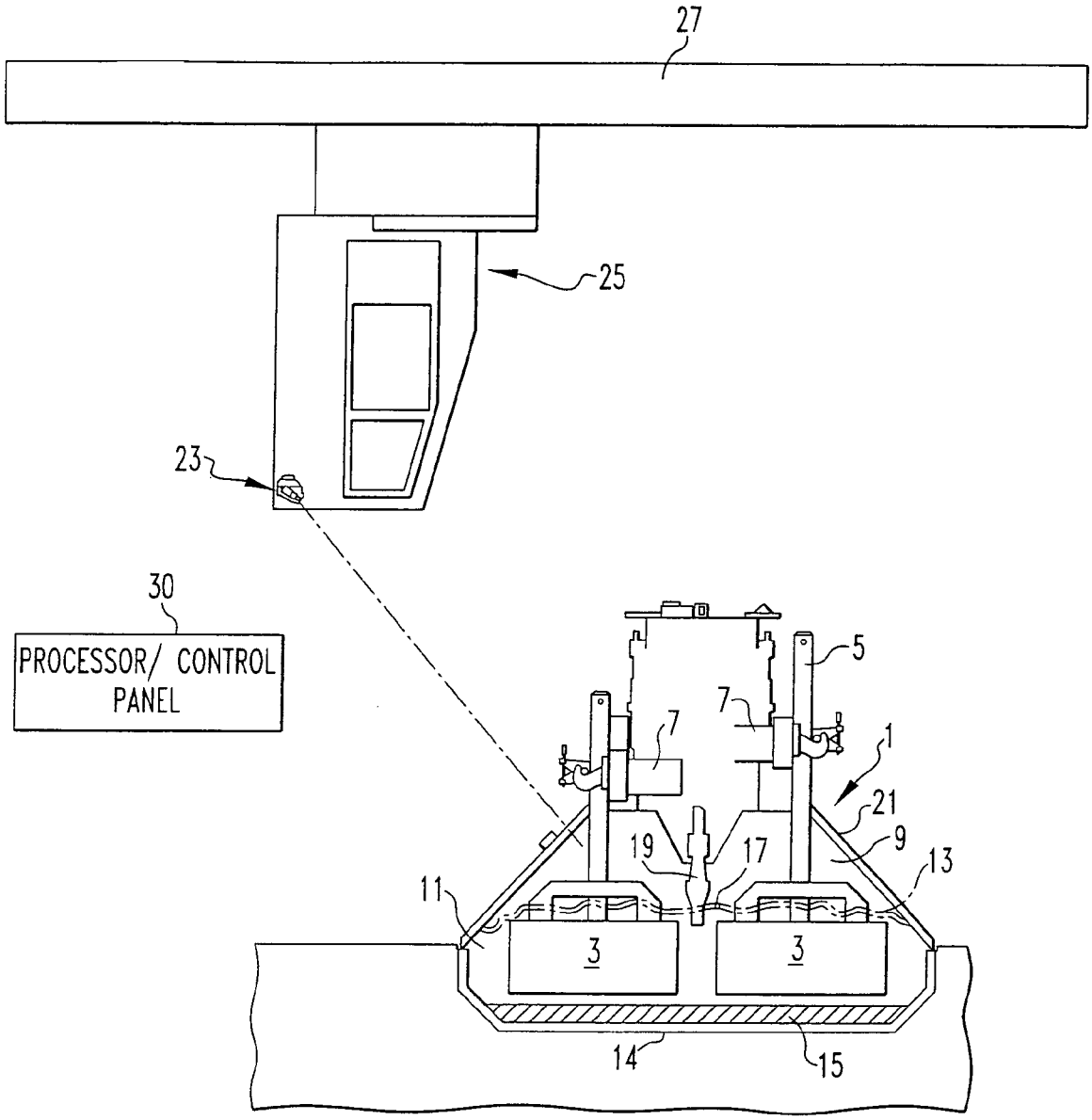
FIG. 1 is a schematic cross-sectional view of an electrolytic cell for producing aluminum in accordance with the invention.

In FIG. 1 there is shown an electrolytic cell 1 for aluminum production, including carbon anodes 3 suspended by anode rods 5 from a bridge 7. The anodes 3 are situated within a cell chamber 9.

A molten cryolite electrolyte 11 containing dissolved alumina is maintained at approximately 950-960° C. within the chamber 9. A layer of solid crust 13 forms above the molten electrolyte 11 surrounding the carbon anodes 3. The crust 13 is generally several inches thick. An electric current passes from the anodes 3 to a carbon cathode 14, thereby forming a molten metal pad or aluminum pad 15.

The movable bridge 7 is adjustable vertically to enable the carbon anodes 3 to be elevated or lowered relative to the molten electrolyte bath 11. Alumina is periodically added to the bath 11 as needed, through a feeder mechanism 19. When alumina is added to the bath 11, the feeder mechanism 19 is thrust downwardly to punch a hole 17 in the crust 13.

Tapping molten aluminum from the metal pad 15 requires breaking the crust 13 to insert a vacuum tap (not shown). In a typical Hall-Heroult electrolytic cell, molten aluminum is tapped approximately every 24 hours. After the tap is removed a hole 17 remains in the crust 13 above the molten electrolyte 11. Holes left over from molten metal tapping typically have dimensions of about 12 in.×12 in. (30 cm.×30 cm.).

Holes 17 in the crust 13 may be repaired by covering the holes with masses of solid particles comprising alumina, crushed cryolite, or mixtures thereof Alternatively, a hole 17 may be repaired by covering with a paper bag filled with solid particles in accordance with the method disclosed in Cotten U.S. Pat. No. 6,440,294, the disclosure of which is incorporated by reference to the extent consistent with the present invention. The paper bag is preferably double walled and is filled with approximately 20 lb. (9.1 kg.) of a mixture of smelting grade alumina (SGA) and crushed cryolite. A mixture of 10 lb. SGA and 10 lb. crushed cryolite is quite suitable.

Alumina and cryolite particles in the bag are sintered into a porous mass by heat from the molten bath 11. The crust 13 is eventually restored to an unbroken, unitary mass.

Figure 2:
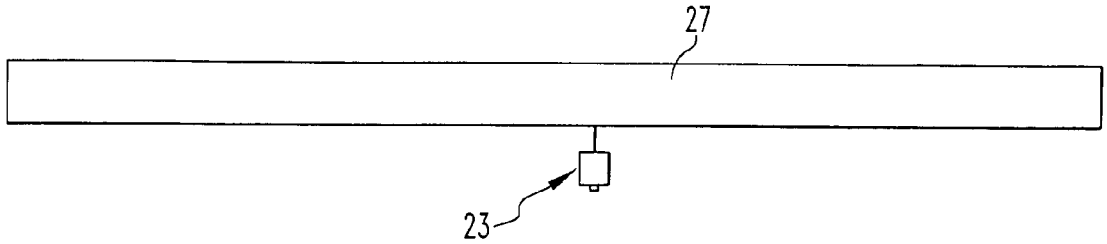
FIG. 2 is a schematic cross-sectional view of an alternative embodiment of an electrolytic cell for producing aluminum in accordance with the invention.
Figure 2:
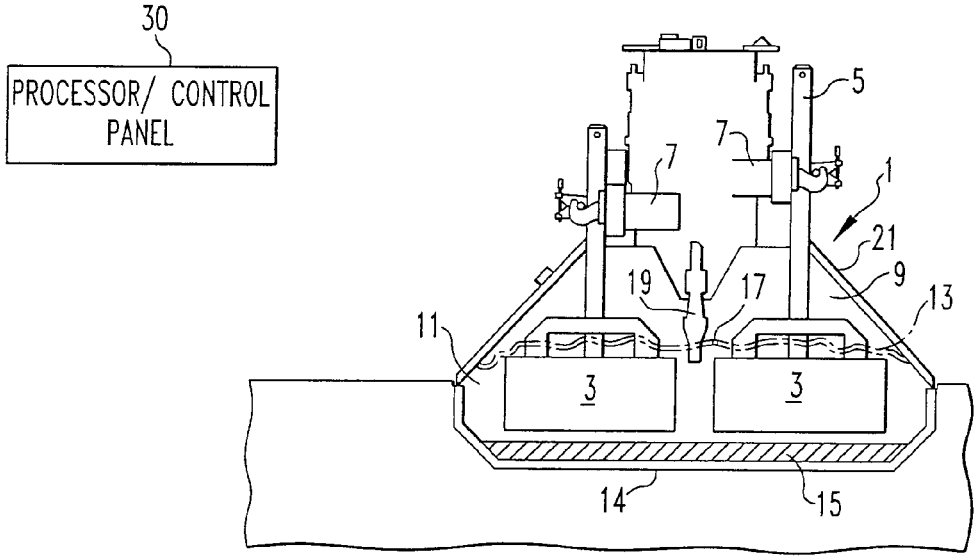

Fumes escaping from holes 17 in the crust 13 are confined by a metal hood 21. The infrared sensor 23, mounted on either the cab 25, as seen in FIG. 1, or the crane bridge 27, as seen in FIG. 2, travels adjacent to the potline and scans the thermal image of the pot's hooding 21. The thermal image is sent to a data processor 30, preferably an electronic data processor. The data processor optimally comprises a hand-held computer or programmed with thermal imaging analysis software to extrapolate the actual temperature of the outer surface of the hood 21. The data processor may be a personal digital assistant ("PDA"). The sensor 23 preferably transmits a signal to the data processor 30 by means of radio waves. Other suitable means of transmission include infrared, visible light, laser light, other wireless means, and traditional metal wires.

Cells exhibiting an actual hood temperature deviating from a target temperature are inspected for crust holes 17. If a crust hole 17 is observed, the hole 17 is repaired to reduce heat losses and escaping fumes. In addition, when the actual hood temperature is too high, the actual rate of addition of sodium fluoride to the cell is generally increased to an actual rate above the standard rate of addition. Accordingly, fluorides lost in vapors escaping through open holes 17 are replenished so that bath ratio deviations are limited. When the actual hood temperature is less than a target temperature, the actual rate of addition of sodium fluoride to the bath is lowered below the standard rate so that the sodium fluoride-aluminum fluoride bath ratio is maintained within desired limits.

Alternatively, when the actual hood temperature is greater than the target temperature, the actual rate of addition of aluminum fluoride may be increased above the standard rate without inspecting the crust for crust holes. When the actual temperature of the pot's hood is less than the target temperature, the actual rate of aluminum fluoride addition to the cell is reduced below the standard rate.

When the measured temperature of the pot's hood is about equal to the target temperature, the rate of aluminum fluoride addition is unchanged.

Having described the presently preferred embodiments, it is to be understood that the invention may be otherwise embodied within the scope of the appended claims.

What is claimed is:

1. A process for determining whether to inspect an aluminum electrolysis cell for a crust hole the process comprising:

(a) operating an aluminum electrolysis cell having hooding connected therewith;

(b) confining fumes evolved from the aluminum electrolysis cell via the hooding;

(c) moving a crane adjacent to the aluminum electrolysis cell, the crane having an infrared sensor mounted thereto;

(d) sensing infrared radiation on the outer surface of the hooding with the infrared sensor to obtain a thermal image of the hooding;

(e) sending the thermal image to a data processor;

(f) extrapolating an actual temperature of the hooding from the thermal image of the hooding via the data processor; and (h) when the actual temperature varies from a target hooding temperature by more than a preselected limit, inspecting the crust of the aluminum electrolysis cell for a crust hole.

2. The process of claim 1, wherein the sending the thermal image step comprises transmitting the thermal image to a hand-held computer.

3. The process of claim 2, wherein the transmitting the thermal image step comprises a wireless transmission.

4. The process of claim 1, further comprising:

estimating the open area in the crust of the cell via the thermal image.

5. The process of claim 4, further comprising: predicting the daily amount of $AlF_3$ addition for the aluminum electrolysis cell based on the open area in the crust.

6. The process of claim 1, further comprising:

completing steps (a)-(h) for each of a plurality of aluminum electrolysis cells.

7. A system for determining whether to inspect an aluminum electrolysis cell for a crust hole, the system comprising:

an aluminum electrolysis cell for producing aluminum metal;

hooding for confining fumes evolved from the aluminum electrolysis cell;

a crane operable to travel adjacent the aluminum electrolysis cell;

an infrared sensor mounted to the crane, wherein the infrared sensor scans the hooding to obtain a thermal image of the hooding; and a data processor for extrapolating the actual temperature of the hooding based on the thermal image of the hood and for comparing the actual temperature to a target hood temperature, wherein the infrared sensor transmits the thermal image to the data processor, and wherein when the actual temperature of the hooding varies from the target temperature an indication is provided to inspect the crust of the aluminum electrolysis cell for a crust hole.

8. The system of claim 7, wherein the data processor comprises a hand-held computer.

9. The system of claim 8, wherein the hand-held computer is a personal digital assistant.

10. The system of claim 7, wherein the infrared sensor is operable to transmit thermal image to the data processor via a wireless transmission.

* * * * *